US005473790A

United States Patent [19]

Desmarais

[11] Patent Number: 5,473,790

[45] Date of Patent: Dec. 12, 1995

[54] COLLAPSIBLE DUST PAN

[76] Inventor: Roger Desmarais, 381 Notre-Dame, Drummondville, Quebec, Canada, J2B 2K7

[21] Appl. No.: 241,702

[22] Filed: May 12, 1994

[30] Foreign Application Priority Data

Jul. 12, 1993 [GB] United Kingdom ..... 9314368

[51] Int. Cl.[6] ..... A47L 13/52

[52] U.S. Cl. ..... 15/257.7; D32/74

[58] Field of Search ..... 15/257.1–257.9; 294/1.4, 53.5; D32/74

[56] References Cited

U.S. PATENT DOCUMENTS

| | | | |
|---|---|---|---|
| 398,997 | 3/1889 | Bailey | 15/257.9 |
| 472,371 | 4/1892 | Lees, Jr. | 15/257.7 |
| 614,858 | 11/1898 | Grove | 15/257.4 |
| 842,946 | 2/1907 | Delaney et al. | 15/257.7 |
| 844,168 | 2/1907 | Murray | 15/257.7 |
| 849,239 | 4/1907 | Hill | 15/257.2 |
| 861,195 | 7/1907 | Shank | 15/257.2 |
| 900,705 | 10/1908 | Chapman | 15/257.7 |
| 958,255 | 5/1910 | Koertner | 15/257.7 |
| 1,055,265 | 3/1913 | Gibson | 15/257.7 |
| 1,311,802 | 7/1919 | Benedict | 15/257.9 |
| 2,122,767 | 7/1938 | Williams | 15/257.7 |
| 2,699,050 | 1/1955 | MacKay | 15/257.7 |
| 3,449,786 | 6/1969 | Ross | 15/257.7 |
| 3,971,095 | 7/1976 | Fish, Sr. | 15/257.7 |

FOREIGN PATENT DOCUMENTS

| | | | |
|---|---|---|---|
| 24804 | 7/1951 | Finland | 294/53.5 |
| 26710 | 7/1954 | Finland | 15/257.7 |
| 170697 | 3/1960 | Sweden | 294/53.5 |

*Primary Examiner*—Mark Spisich
*Attorney, Agent, or Firm*—Eric Fincham

[57] ABSTRACT

There is provided a dustpan which has a rear wall which extends upwardly from a base and is angled inwardly towards the base to form an angle of less than 90° between the rear wall and the base member such that a handle attached to the dustpan near the rear wall will remain standing in an upright manner and be supported by the rear wall.

3 Claims, 2 Drawing Sheets

COLLAPSIBLE DUST PAN

BACKGROUND OF THE INVENTION

The present invention relates to a dustpan and more particularly, to improvements in dustpans.

Dustpans are well known in the art and are used to pickup dust or debris following a sweeping operation. Many such dustpans are known in the art with the basic dustpan comprising a base, a rear wall, a pair of side walls, and a relatively short handle extending horizontally from the rear wall in a plane which is generally parallel to the base. This type of dustpan requires bending over or stooping of the person using the same and to obviate this, there have been proposals in the art for various types of dustpans which incorporate extended handles. Thus, for example, there is shown a dustpan having an extended handle and with a spout for emptying collected debris in U.S. Pat. No. 2,864,117 to Williams. Other arrangements having extended handles include, for example the dustpan of U.S. Pat. No. 4,562,611 wherein an elongated handle is provided with the dustpan pivotably mounted on the handle for emptying purposes.

Some of the problems which still exist with such dustpans is the relationship of the handle to the dustpan. Typically, when using the dustpan for a plurality of operations, one must leave the dustpan by itself while continuing a sweeping operation. Most of the known dustpans will have the handle fall down to the floor thereby again requiring a stooping or bending operation by the person using the dustpan. Also, a similar problem occurs when the dustpan is to be stored. It is desirable that the pan can be stored with the handle in an upright position and easily removed therefrom.

SUMMARY OF THE INVENTION

It is an object of the present invention to provide a dustpan wherein the handle will remain in an upright position without requiring any exterior support.

It is a further object of the present invention to provide a dustpan which is simple and economic to manufacture.

According to one aspect of the present invention, there is provided a dustpan which includes a substantially planar base member having a front edge, a rear edge and a pair of side edges which extend between the front and rear edges. A rear wall extends upwardly from the rear edge of the planar base member, with the rear wall also being angled inwardly towards the base member to thereby form an angle of less than 90° with respect thereto. Side walls extend upwardly from the side edge. There is provided a handle receiving member which is adjacent the rear wall, the handle receiving member being such that when a handle is attached thereto, the handle can be supported by the rear wall when in an upright position.

In greater detail, the dustpan may be formed of different materials which are well known in the art including, for example, a metallic material. However, for reasons which will become apparent hereinbelow, it is particularly preferred that the dustpan be formed as a single unit of a plastic material. The particular plastic material can be selected from many such known materials; however, it is preferred that the plastic material have the property of being flexible at a certain thickness and also being durable and capable of being flexed a number of times without substantial deterioration of the material.

As is conventional, the base member of the dustpan will have a substantially planar configuration. In this respect, it will be understood that the base member may be formed such that the front edge is beveled to assist in pickup of the dust or debris and indeed, the base member may be itself slightly angled to better place the front edge in contact with the surface on which the debris is to be picked up. In other words, when placed on the floor, the base member may be somewhat inclined with respect to the floor as is well known in the art.

Side walls are provided for the purpose of containing the dirt or debris which is picked up and as such, may be formed in different configurations including having a somewhat triangular shape with an angled upper edge as is well known in the art.

The rear wall of the dust pan, as previously mentioned, is preferably formed integrally with the base member and extends upwardly and inwardly with respect thereto such that the angle between the base member and the rear wall is less than perpendicular or 90°. Preferably, the rear wall is angled inwardly such that it forms an angle of between 2° and 15° with respect to the vertical or in other words the rear wall forms an angle of between 75° and 88° with respect to the base member.

The handle receiving member of the dustpan can be formed in several different manners. Thus, the attachment between the handle and the dustpan may be such as to permit rotational movement in at least one direction through use of a suitable joint. It is essential that the attachment be such that the handle is pivotable through a range where at one extremity, it can lie adjacent the rear wall and then be pivotable to a more rearward position.

In a preferred embodiment, the handle receiving member has a portion thereof which functions as a hinge member. To this end, a portion of the handle receiving member may comprise a substantially planar extension of the base member and which is of a thickness so as to permit flexing thereof. This hinge member, as previously mentioned, is preferably formed integrally with the main portion of the dustpan; in an alternative, a separate portion may be used and suitably secured to the pan by adhesive means or welding or a similar operation.

The means of attaching the handle to the handle receiving element may be selected among many known arrangements.

Having thus generally described the invention, reference will be made to the accompanying drawings illustrating an embodiment thereof, in which:

DETAILED DESCRIPTION OF THE INVENTION

Figure 1:
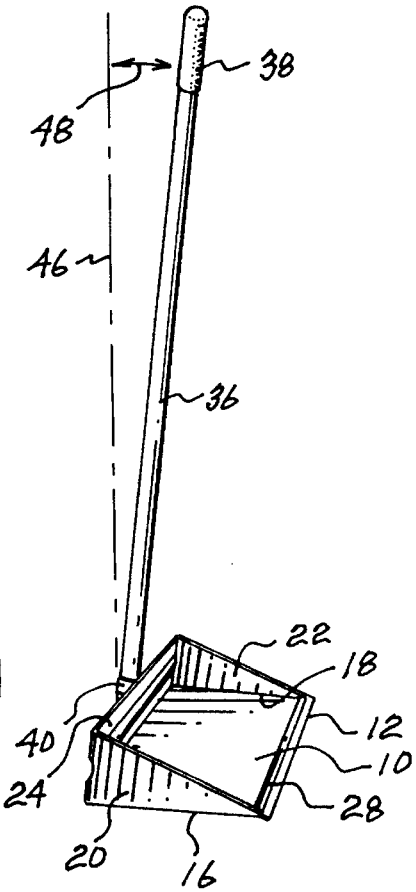
FIG. 1 is a perspective view of a dustpan according to the present invention.

Referring to the drawings in greater detail, and by reference characters thereto, the dustpan includes a base 10 which is of a generally rectangular configuration and has a front edge 12, a rear edge 14 and a pair of opposed side edges 16 and 18.

Extending upwardly from side edges 16 and 18 respectively are side walls 20 and 22. As may be seen, side walls 20 and 22 are of a somewhat triangular configuration and merge to meet a rear wall 24 which extends upwardly from rear edge 14. A reinforcing rib 26 is formed in rear wall 24. Also, as may be seen from the drawings, base portion 10 has a rib 28 which extends along front edge 12 to assist in retaining dust or other debris which is placed in the dustpan.

Rear wall 24, while extending upwardly from rear edge 14 of base 10, does so at an inwardly inclined angle for reasons which will become apparent hereinafter.

Figure 2:
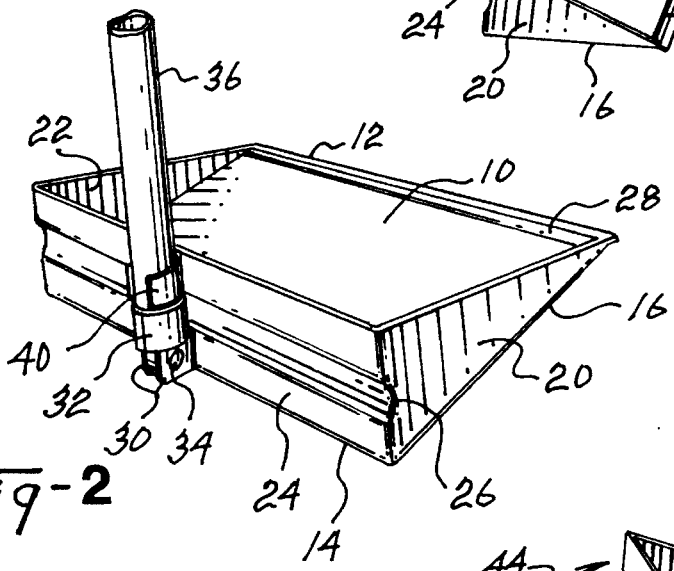
FIG. 2 is a perspective view illustrating the rear wall portion thereof.

Rear wall 24, as may be seen from FIG. 2, has a pair of parallel ears or flanges 30 extending outwardly from the rear wall. Flanges 30 each have an aperture extending therethrough. A coupling member 32 having internal threads formed therein, is secured to flanges 30 by means of a pin which extends through coupling member 32 and flanges 30.

A handle 36, which has a gripping portion generally designated by reference numeral 38, is screw threadedly engaged with coupling member 32.

Figure 3:
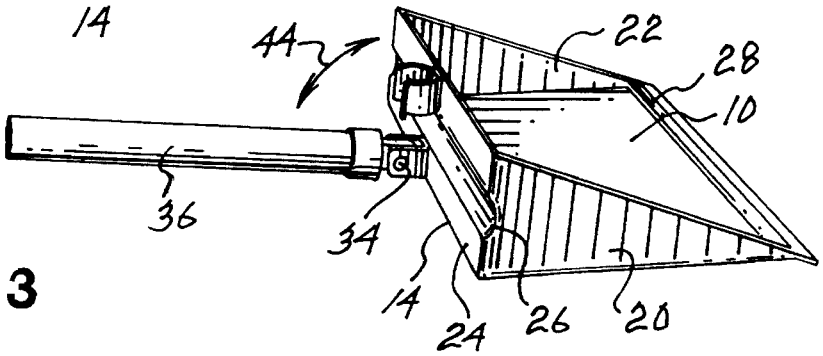
FIG. 3 is a perspective view illustrating movement of the handle.

As shown in FIGS. 1 to 3, the dustpan may include retaining means for the handle and to this end, a retaining clip arrangement designated by reference numeral 40 may be formed integrally with rear wall 24 and is of a somewhat flexible nature such that it is adapted to retain handle 36.

As shown in FIG. 3, the pivotable connection between coupling member 32 and the dustpan permits rotational movement of the handle as indicated by arrow 44. Also, as may be seen in FIG. 1, the inward angled rear wall 24 permits the handle 36 to remain in an upright position when the dustpan is in its normal ready to use orientation. Thus, handle 36 which essentially lies parallel to rear wall 24 forms an angle 48 with respect to a vertical line 46.

Figure 4:
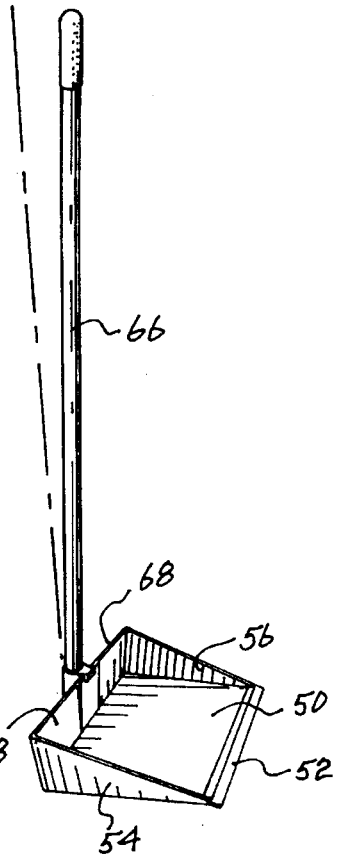
FIG. 4 is a perspective view similar to FIG. 1 of a further embodiment.
Figure 5:
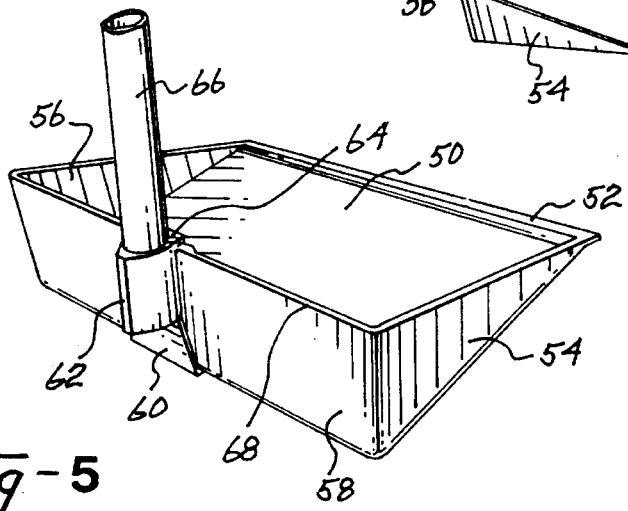
FIG. 5 is a perspective view similar to FIG. 2 of the embodiment of FIG. 4.
Figure 6:
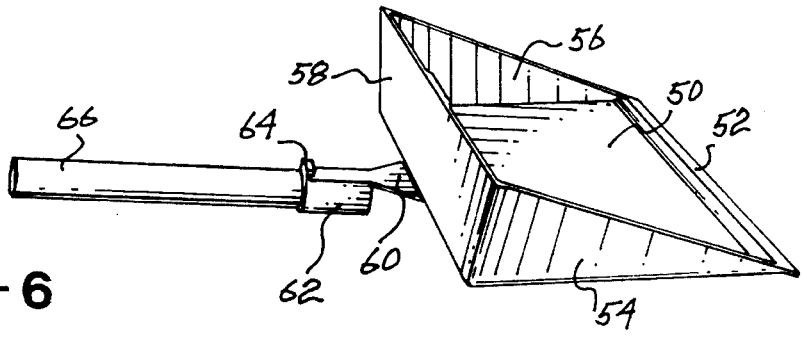
FIG. 6 is a perspective view of the embodiment of FIG. 4 showing movement of the handle.

Referring to FIGS. 4 to 6, a further embodiment of the invention is illustrated with many of the components being similar to that of FIGS. 1 to 3 and thus, will not be described in detail.

In the embodiment of FIGS. 4 to 6, there is provided a base 50 having a dirt retaining rib 52 extending along the front edge thereof. Side walls 54 and 56 extend upwardly from the base as does an inwardly angled rear wall 58.

An integrally formed flange 60 extends outwardly from base 50 (FIG. 6) and is of a flexible nature. A coupling member 62 is also formed to receive handle 66 by means of a friction fit. It will be noted that coupling member 62 may include a clip member 64 adapted to engage the upper peripheral edge 68 of rear wall 58.

It will be understood that the above described embodiments are for purposes of illustration only and that changes and modifications may be made thereto without departing from the spirit and scope of the invention.

What is claimed is:

1. A dustpan adapted for use with an elongated handle comprising a substantially planar base member having a front edge, a rear edge, and a pair of side edges extending between said front and rear edges, a rear wall extending upwardly from said rear edge of said base, said rear wall being angled inwardly towards said front edge of said base member to thereby form an angle of less than 90° between said rear wall and said base member, a side wall extending upwardly from each of said side edges, a handle receiving member adjacent said rear wall, said handle receiving member having first and second portions wherein the second portion extends from a point adjacent the rear wall and the first portion extends from an end of the second portion, an elongated cavity being formed in said first portion, said elongated cavity being sized to receive and frictionally engage an end of said elongated handle, said second portion having a thickness less than the first portion which is sufficiently small so as to permit said second portion to flex about its point of attachment adjacent the rear wall and function as a hinge between said first portion and said rear wall such that said elongated cavity is angularly moveable with respect to said rear wall, said base member, rear wall, side walls and said handle receiving member being a one-piece member formed of molded plastic.

2. The dustpan of claim 1 further including clip means on said first portion, said clip means being adapted to engage an upper edge of said rear wall to retain said first portion in a position adjacent thereto with said elongated cavity having its longitudinal axis substantially parallel to said rear wall.

3. A dustpan adapted for use with an elongated handle, said dustpan consisting essentially of a substantially planar base member having a front edge, a rear edge, and a pair of side edges extending between said front and rear edges, a rear wall extending upwardly from said rear edge of said base, said rear wall being angled inwardly towards said front edge of said base member to thereby form an angle of between 75° and 88° between said rear wall and said base member, a side wall extending upwardly from each of said side edges, a handle receiving member having first and second portions wherein the second portion extends from a point adjacent the rear wall and the first portion extends from an end of the second portion, an elongated cavity being formed in said first portion, said elongated cavity being sized to receive and frictionally engage an end of said elongated handle, said second portion having a thickness less than the first portion which is sufficiently small so as to permit said second portion to flex about its point of attachment adjacent the rear wall and function as a hinge between said first portion and said rear wall, said base member, rear wall, side walls and said handle receiving member being a one-piece member formed of molded plastic.

* * * * *